US009657990B2

(12) United States Patent
Tandon

(10) Patent No.: US 9,657,990 B2
(45) Date of Patent: May 23, 2017

(54) APPARATUS FOR THERMAL DEGRADATION OF FEEDSTOCK

(75) Inventor: Amit Tandon, Haryana (IN)

(73) Assignee: Amit Tandon, Haryana (IN)

( * ) Notice: Subject to any disclaimer, the term of this patent is extended or adjusted under 35 U.S.C. 154(b) by 477 days.

(21) Appl. No.: 14/123,979

(22) PCT Filed: Jun. 4, 2012

(86) PCT No.: PCT/IB2012/052801

§ 371 (c)(1),
(2), (4) Date: Dec. 5, 2013

(87) PCT Pub. No.: WO2012/168850

PCT Pub. Date: Dec. 13, 2012

(65) Prior Publication Data

US 2014/0097075 A1 Apr. 10, 2014

(30) Foreign Application Priority Data

Jun. 6, 2011 (IN) ..... 1597/DEL/2011

(51) Int. Cl.

| | |
|---|---|
| ***F27B 7/30*** | (2006.01) |
| ***F23G 5/027*** | (2006.01) |
| ***F23G 5/20*** | (2006.01) |
| ***F27B 7/10*** | (2006.01) |
| ***F27B 7/20*** | (2006.01) |

(52) U.S. Cl.

CPC ..... *F27B 7/30* (2013.01); *F23G 5/027* (2013.01); *F23G 5/20* (2013.01); *F27B 7/10* (2013.01); *F27B 7/20* (2013.01)

(58) Field of Classification Search

CPC .... F23G 5/027; F23G 5/20; F27B 7/10; F27B 7/20; F27B 7/30

See application file for complete search history.

(56) References Cited

U.S. PATENT DOCUMENTS

| | | | | |
|---|---|---|---|---|
| 1,664,723 A * | 4/1928 | Young | C10B 47/30 | 201/5 |
| 4,094,769 A * | 6/1978 | Brown | C10B 47/44 | 201/33 |
| 4,289,949 A * | 9/1981 | Raaness et al. | B23K 10/00 | 219/121.36 |
| 5,584,969 A | 12/1996 | Nagai et al. | | |
| 5,653,183 A * | 8/1997 | Hansen et al. | C10B 7/10 | 110/229 |

FOREIGN PATENT DOCUMENTS

CA 1127575 A 7/1982

* cited by examiner

*Primary Examiner* — Gautam Prakash

(57) ABSTRACT

An apparatus (100) is provided for thermal or thermal-catalytic degradation of feedstock. The apparatus includes a retort vessel (102). The retort vessel (102) is configured to receive feedstock. Further, the retort vessel includes at least one partition structure (106), wherein the partition structure (106) divides the retort vessel into volumetric zones and extends from an input end (122) of the retort vessel (102) to an output end (124) of the retort vessel (102). The retort vessel (102) is declined to facilitate movement of the feedstock from an input end (122) of the retort vessel (102) towards output end (124) of the retort vessel (102). Further, the retort vessel (102) is configured to rotate angularly and heated to facilitate thermal or thermal-catalytic degradation of the feedstock.

10 Claims, 2 Drawing Sheets

APPARATUS FOR THERMAL DEGRADATION OF FEEDSTOCK

BACKGROUND

Field

Embodiments relate generally to the field of thermal decomposition and, more particularly but not exclusively, to retorts that are used in thermal decomposition.

Discussion of Related Field

Thermal decomposition is a process in which feedstock is heated to enable chemical reaction that results in breaking of the feedstock into multiple substances. In certain applications, catalyst may be used during thermal decomposition to reduce the temperature and pressure requirements of thermal decomposition and achieve desired results.

The concept of thermal and thermal-catalytic decomposition has been applied in various fields. One such field is recycling of waste feedstock, such as waste plastics to obtain original monomers, petroleum fuels, waxes, fuel oils, syngas and other useful chemical products.

To obtain petroleum fuels, waste plastics can be recycled using thermal or thermal-catalytic decomposition in an inert atmosphere. Thermal decomposition of waste plastic is enabled by shredding or thermally liquefying waste plastics and feeding the same to a reactor. The material is heated in the reactor, which results in formation of byproducts, such as, vaporized hydrocarbons and residual char. The vapors may be further reformed catalytically and are condensed to obtain fuel oils, while the char is removed from the reactor.

Primarily, there are three types of reactor designs, which are, vertical, horizontal and inclined. A vertical reactor design is provided in U.S. Pat. No. 5,584,969 (hereinafter referred to as US'969). The vertical reactor of US'969 is provided with a curved bottom end. Residue resulting from the reaction is accumulated at the center portion of the bottom surface of the reactor. The accumulated residue is removed from the reactor using suction produced by a vacuum pump. However, such vertical reactors require elaborate mechanisms for scraping of residual matter and contaminants generated during the decomposition of feedstock. Also, the use of vacuum for removing residual matter, results in loss of any useful feedstock in which the residue matter may be contained.

As recited earlier, horizontal reactors may also be used to enable thermal decomposition. Canadian Patent 1127575 discloses a horizontal reactor. The reactor is configured to receive feedstock at a first end, and at the second end, the reactor is provided with outlets for vapor and solid residue. The feedstock is conveyed from the first end towards the second end using a spiral conveyer. Since residual matter tends to stick all along the inside walls of such a conveyor, such reactors too require elaborate scraping mechanism for removal of residual matter generated during the thermal decomposition process. Such conveyors typically consist of an assembly of shafts and blades to push the feedstock towards the exit end. These shafts and blades take away valuable volumetric space which would have otherwise been available to the feedstock, thereby leading to an increase in the size of the thermal decomposition apparatus.

An adaptation of the horizontal reactor design is inclined reactor design. U.S. Pat. No. 4,094,769 discloses an inclined reactor. The reactor is configured to receive feedstock at a first end and discharge residue at a second end. The reactor is inclined in such a way that the first end is at a greater distance as compared to the second end, relative to the ground. The inclination facilitates movement of the feedstock from the first end towards the second end, due to gravity. The reactor deploys a conveyor to push the feedstock towards the exit end. Such conveyor typically consist of an assembly of shafts and blades. These shafts and blades take away valuable volumetric space which would have otherwise been available to the feedstock, thereby leading to an increase in the size of the thermal decomposition apparatus. Also, a fixed minimal gap needs to be maintained between the inside of the barrel of the conveyor and the moving blades for the conveyor to push the feedstock and any byproducts towards the exit end. Maintaining such a fixed gap may become cumbersome owing to normal wear & tear of conveyor with use.

In light of the foregoing discussion, there is a need for a technique that enables continuous removal of non-gaseous byproducts from the reactor formed during thermal or thermal-catalytic degradation process without resorting to mechanisms that comprise significantly on the volumetric space available for feedstock movement or which result in loss of useful feedstock or which require a shutdown of the process to remove the non-gaseous byproducts. The technique may enable provision of increased space for feedstock within the reactor, while enabling continuous removal of non-gaseous byproducts from the reactor. Furthermore, the technique may enable minimizing non-gaseous byproducts from accumulating in the reactors, thereby facilitating homogeneous heat transfer in the reactor and enhanced efficiency.

SUMMARY

Accordingly the invention provides an apparatus for thermal or thermal-catalytic degradation of feedstock. The apparatus includes a retort vessel. The retort vessel is configured to receive feedstock. Further, the retort vessel includes at least one partition structure, wherein the partition structure divides the retort vessel into volumetric zones and extends from an input end of the retort vessel to an output end of the retort vessel. The retort vessel is declined to facilitate movement of the feedstock from an input end of the retort vessel towards output end of the retort vessel. Further, the retort vessel is configured to rotate angularly and heated to facilitate thermal degradation of the feedstock.

These and other advantages of the present invention will be clarified in the description of the embodiments taken together with the attached drawings in which like reference numerals represent like elements throughout.

BRIEF DESCRIPTION OF DRAWINGS

Embodiments are illustrated by way of example and not limitation in the Figures of the accompanying drawings, in which like references indicate similar elements and in which.

DETAILED DESCRIPTION

Figure 1:
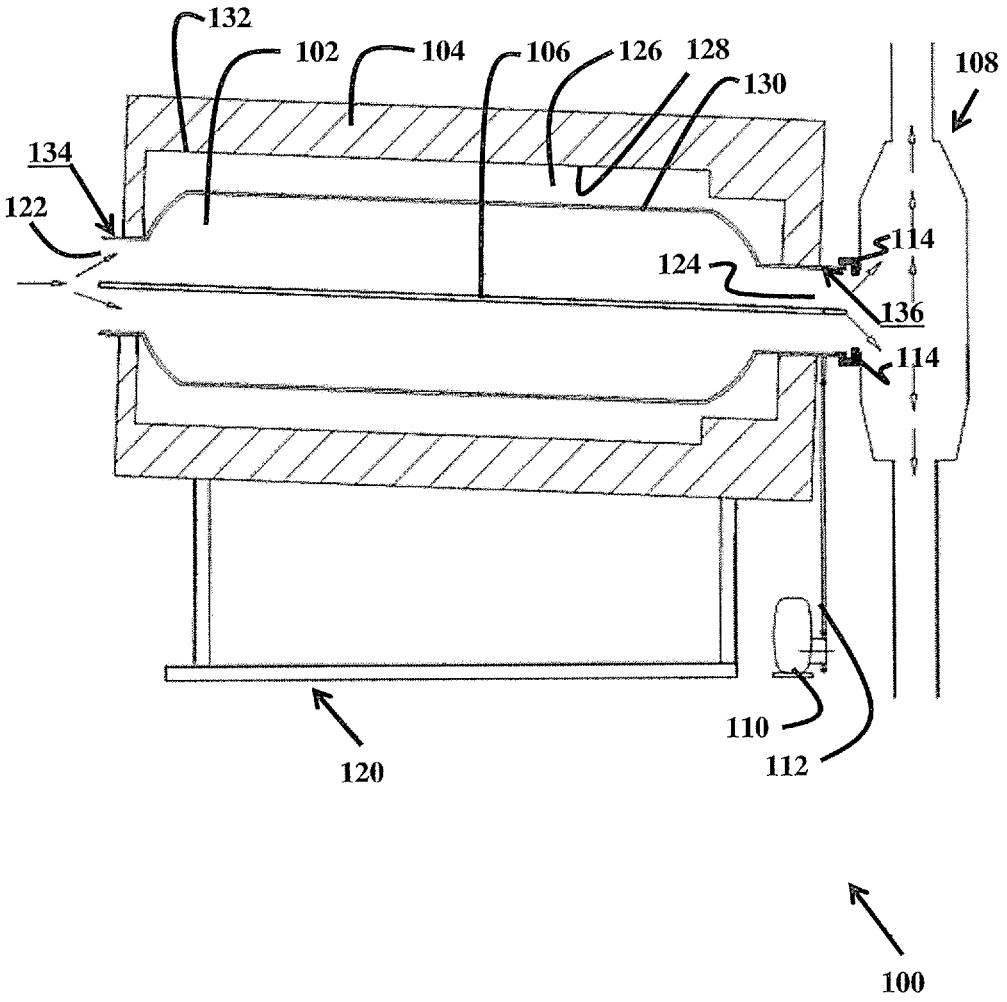
FIG. 1 is a schematic cross sectional side view of an apparatus 100 for enabling thermal degradation of feedstock, in accordance with an embodiment.

The following detailed description includes references to the accompanying drawings, which form a part of the detailed description. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical, and electrical changes can be made without departing from the scope of what is claimed. The following detailed description is, therefore, not to be taken in a limiting sense, and the scope is defined by the appended claims and their equivalents.

In this document, the terms "a" or "an" are used, as is common in patent documents, to include one or more than one. In this document, the term "or" is used to refer to a nonexclusive "or," such that "A or B" includes "A but not B," "B but not A," and "A and B," unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

Embodiments provide an apparatus for enabling thermal or thermal-catalytic (hereinafter referred to as thermal) decomposition of feedstock. The apparatus is configured to receive feedstock continuously (or if desired in batches) and heat the feedstock to thermally decompose it. The byproduct of the thermal decomposition can be in the form of gaseous and non-gaseous matter The feedstock received by the apparatus can be for example plastics, (such as Polypropylene (PP), Polystyrene (PS), Low Density Polyethylene (LDPE), High Density Polyethylene (HDPE), Poly Vinyl Chloride (PVC), Polyethylene terephthalate (PET), Poly Carbonate (PC), Nylon etc.), biomass, organic matter, municipal waste, cellulosic fibre and other thermally decomposable material. The feedstock received by the apparatus may be solid, liquid or a mixed slurry and depending upon the intended application, be pre-processed or thermally heated before being fed to the apparatus. It shall be noted that the feedstock may also include one or more catalyst based on the intended application. Further, based on the objective of thermal decomposition and the feedstock being decomposed, the operating parameters such as temperature and pressure in the retort vessel, angle of inclination of retort vessel and angular velocity of the retort, among other parameters, may be varied using controls provided for the same. Also, based on the objective of thermal decomposition and the feedstock being decomposed, gases such as oxygen, nitrogen, hydrogen, air etc. may be fed into the retort vessel along with the feedstock.

Figure 2:
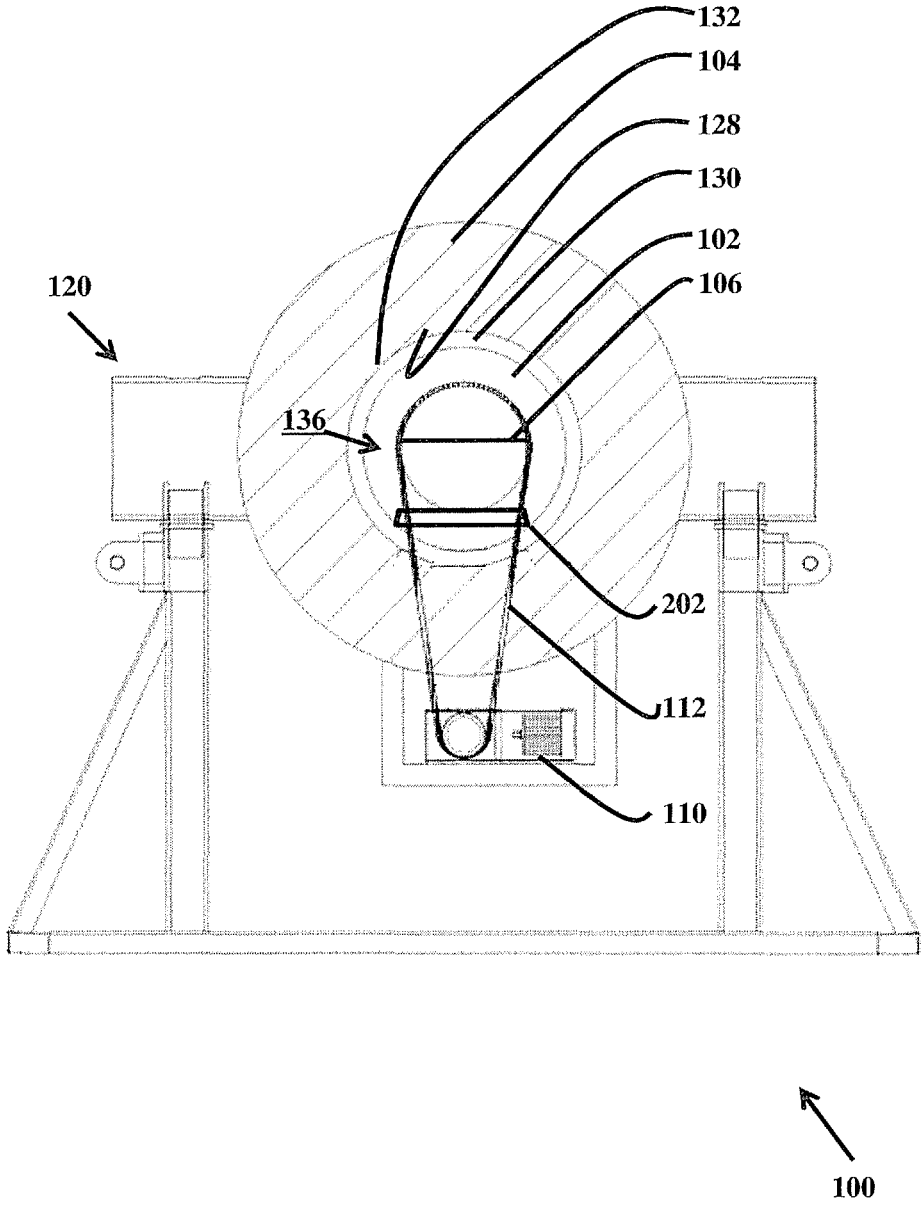
FIG. 2 is a schematic cross sectional rear view illustrating a tilting mechanism 120 for tilting a retort vessel 102, in accordance with an embodiment.

FIG. 1 is a schematic cross sectional side view of an apparatus 100 for enabling thermal degradation of feedstock, in accordance with an embodiment. The apparatus 100 includes a retort vessel 102, an insulation structure 104, a shell 132, a partition structure 106, a gas-residue separator 108, a motor 110, a belt 112, a leak-proof seal 114, tilting mechanism 120 and roller arrangement 202 (illustrated in FIG. 2).

Retort vessel 102 includes an input end 122 and an output end 124. The input end is configured to receive continuously (or if desired in batches) feedstock which has to be thermally decomposed, while the output end 124 is engaged with the gas-residue separator 108, to which the byproducts of thermal decomposition are passed.

Further, retort vessel 102 has positive declination toward the ground. In other words, distance between the ground and a point, which is closer to the output end 124, on the longitudinal axis of the retort vessel 102 is lesser than the distance between the ground and a point, which is closer to the input end 122, on the longitudinal axis of the retort vessel 102. The positive declination facilitates movement of feedstock intermediate products of decomposition and residual matter (solid or liquid) which may be formed as a byproduct during thermal decomposition, towards the output end 124, due to gravity.

The retort vessel 102 may be declined using means known in the art, such as a tilting assembly, which uses a worm wheel or hydraulic cylinder arrangement or like tilting arrangement. The retort vessel 102 may be declined using an arrangement 120 illustrated in FIG. 2.

In light of the foregoing discussion, it shall be noted that retort vessel 102 can be configured to be declined at a predetermined angle while a thermal degradation plant is being built. Alternatively, the angle of declination can be configured based on instant requirement of thermal degradation plant operation.

The retort vessel 102, in addition to having a declination, which facilitates movement of non-gaseous byproducts towards the output end 124, also includes at least one partition structure 106, which facilitates movement of feedstock, intermediate products of decomposition and residual matter towards the output end 124. The partition structure 106 connects the input end 122 to the output end 124. Further, in an embodiment, the partition structure is provided in such a way that it divides the retort vessel 102 into two volumetrically equal zones. It shall be noted that more number of partition structures can be provided to divided the retort vessel 106 into more number of volumetrically equal zones.

In an embodiment, partition structure 106 may be heated. Heating of the partition structure 106 can improve homogeneous heating of the feedstock. In an embodiment, partition element 106 can be hollow structure (in part or in entirety), wherein heating element can be accommodate in hollow sections to enable heating of the partition structure 106. It may be noted that, generally when the retort vessel 102 is heated, the intensity of heat is greater near the circumference of the retort vessel 102 as compared to the intensity of heat near the longitudinal centre of the retort vessel 102. The difference in the intensity of heat might not be substantial in case the retort vessel 102 is of smaller cross section. However, as the size of the retort vessel 102 increases, the difference in the intensity of heat may also increase, thereby resulting in less homogeneous heating of the feedstock. Hence, by heating the partition structure 106, the difference in intensity of heat can be reduced, thereby resulting in enhanced homogeneous heating of the feedstock.

The retort vessel 102, which includes the partition structure 106, is covered with suitable insulation structure 104 to mitigate thermal losses from the system. In an embodiment, the retort vessel 102 is heated by including the same inside a metal shell 132 in such a way that an empty space 126 is defined between the inner surface 128 of the shell 132 and outer surface 130 of the retort vessel 102. It shall be noted that, heating of the retort vessel 102 is required for enabling thermal degradation of feedstock. The retort vessel 102, and thereby the feedstock, is heated either directly by pressurized, high-velocity flame burners which push large volume of heated air into the empty space 126 or indirectly by circulation of hot air or other such media coming from a generator into the empty space 126.

In an embodiment, the retort vessel 102 can be made from material having high corrosive strength such as SS-316 or Hastelloy or other similar material, which provides for corrosion resistance to any acidic vapors that may be produced inside the retort vessel 102.

In an embodiment, a pressurized, high-velocity flame burner system can be used to push heated air into the empty space 126, thereby heating the retort vessel 102. Such a burner system may use at least partially the off-gases coming from the process as fuel for combustion or utilize commodity fuel such as LPG/CNG as fuel. The placement of the burners and flue gas exit (not shown in diagram) in such an embodiment shall be in accordance with standard principles of combustion engineering along the retort vessel's outer wall 130. In another embodiment, in addition to using a burner system or independently, the retort vessel and thereby the feedstock can be heated using air from a hot-air generator.

The hot-air generator may use either off-gas from the thermal decomposition process as fuel or it may utilize commodity fuel such as LPG/CNG or use electrical heaters to heat atmospheric air, which is used as the heat transferring media, to then circulate the heated air into the empty space 126 in a closed loop. It shall be noted that, a heat transferring media other than air can also be used to achieve the objective of heat transfer. The placement of air inlet and flue gas exit (not shown in diagram) in such an embodiment shall be in accordance with standard principles of combustion engineering along the retort vessel's outer wall 130.

In another embodiment, the retort vessel 102 and thereby the feedstock, can be heated by electrical heaters. The placement of electrical heaters and flue gas exit (not shown in diagram) in such an embodiment shall be in accordance with standard principles of combustion engineering along the retort vessel's outer surface 130.

In another embodiment, the flue gas exiting from the retort shell 132 is passed through a gas-air heat exchanger, where thermal heat of the flue gas is used to heat atmospheric air which comes into the heat exchanger at ambient temperatures. The heated air is routed back to either directly heat the retort vessel 102 or is intermixed with process off-gas produced during its combustion.

The retort vessel 102 is heated while being rotated. The rotation of the retort vessel 102, in one embodiment, can be enabled by configuring a belt or slotted chain 112 around the retort vessel 102. The belt or slotted chain 112 is driven by a motor—gear assembly 110. The angular speed of rotation of the retort can be controlled using the motor—gear assembly mechanism and a variable frequency drive (VFD), which is connected to the motor.

The rotating vessel 102 is supported by multiple roller assemblies, which may be positioned along the base of the retort nose 134 & 136. Depending upon the length of the retort vessel 102, the number of rollers deployed to support the retort vessel 102, as well as their location along the base of the retort nose is determined in accordance with standard principles of engineering. For illustration, a single roller assembly 202 is shown at the base of retort nose 136 in FIG. 2.

To prevent gases from retort vessel 102 to escape into any non-process equipment or into the atmosphere, the input end 122 and output end 124 may bemated with upstream and downstream stationary equipment respectively using stationary leak-proof seals or similar equipment known in the art. For the purpose of illustration, FIG. 1 shows such a seal 114 which mates the rotating nose 136 of the retort vessel with the stationary gas residue separator 108.

In another embodiment, the input end 122 and/or the output end 124 of the retort vessel 102 can have a nose-heater mounted on it to ensure that vapors produced as a result of thermal decomposition do not condense at the exit end.

Further, the output end 124 may be engaged with the gas-residue separator 108. The gas-residue separator 108 facilitates separation of gaseous byproducts from non-gaseous byproducts. The byproducts resulting from the thermal degradation move towards the output end 124 and enter the gas-residue separator 108. The gaseous byproducts after entering the gas-residue separator 108 move upwards, while the non-gaseous by products (solids and liquids) move over the partition plate 106 and enter the gas-residue separator 108 and thereupon move downwards into a collection vessel or other downstream process equipment.

The heating of the feedstock produces gases as one of the byproducts. If the pressure at input end 122 happens to be less than the pressure inside the retort, the gases produced tend to escape from the input end 122 of the retort vessel 102. In an embodiment, to prevent condensable gases from escaping from the input end 122, a cooling jacket may be provided near the input end 122. The cooling jacket can be water cooled jacket, wherein low temperature water is circulated into the cooling jacket using a pump, so that water in the cooling jacket is maintained in the desired temperature range. The temperature of the circulating water is kept in accordance to the boiling point of the evolved gases which are to be condensed. It shall be noted that, medium other than water can also be used to achieve the objective of cooling.

During operation (some of the steps, which are well known in the art, involved in beginning of the operation are omitted), motor 110 is switched on, thereby enabling the belt/slotted chain 112 to rotate. The rotating belt/slotted chain 112 in turn enables rotation of the retort vessel 102, which is declined and heated to a desired temperature, to rotate. While the retort vessel 102 is rotating, feedstock is fed into the input end 122 of the retort vessel 102. The feedstock can be fed using mechanisms known in the art, such as screw conveyers or impeller shafts. The incoming feedstock gets divided and channelized into the partition zones as a result of the partition structure 106 provided in the retort vessel 102. The feedstock starts to gradually move towards the output end 124 because of the declination. As the feedstock starts moving, the feedstock is heated, thereby producing byproducts. The byproducts produced by thermal degradation can include gaseous and non-gaseous byproducts. It shall be noted that, the duration for which the feedstock is retained in the retort vessel 102 can be controlled by varying the speed at which the feedstock is fed, the pressure inside the retort vessel, the angle of declination of the retort vessel 102, and the angular speed of rotation of the retort vessel 102. It shall also be noted that, changes made to such variables shall have an effect on the product produced by thermal degradation. The byproducts move towards the output end 124 and enter the gas-residue separator 108. It shall be noted that non-gaseous byproducts may move over the partition plate 106 and enter the gas-residue separator 108. After entering the gas-residue separator 108, the non-gaseous byproducts move downwards into a collection vessel or other process equipment and the gaseous byproducts move upwards. Both the byproducts can be further processed based on the intended application. Further, part of the gaseous byproduct can be used to facilitate heating of the retort vessel 102. Such an apparatus 100 may be used in a variety of applications, such as recycling of waste plastics, biomass, organic matter etc. The example below describes application of the apparatus 100 for recycling waste plastics.

EXAMPLE

The apparatus 100 can be used for recycling waste plastic. The apparatus 100 may receive waste plastic feedstock from municipal or industrial waste sources including polymers such as Polypropylene (PP), Polystyrene (PS), Low Density Polyethylene (LDPE), High Density Polyethylene (HDPE) etc. Such feedstock may have been priory presorted to eliminate undesirable material from it, shredded and/or thermally heated before being fed to the apparatus. Additionally, one or more catalysts or chemical materials may be added to facilitate thermal degradation of the feedstock at lower temperature, facilitate neutralization of any evolved acidic vapors or facilitate catalytic cracking. The plastic feedstock as it is being fed into the retort vessel 102 gets channelized into the partition zones within the retort vessel 102. This feedstock gets heated and byproducts are produced. The byproducts include gaseous byproduct and non-gaseous (solid, liquid) residual matter. The residual matter can include char and other non-vaporizable material, while the gaseous byproduct include hydrocarbon vapors. The byproducts move towards the output end 124 and enter the gas-residue separator 108. It shall be noted that the partition structure 106 provides a surface for the non-gaseous byproducts to move over it and enter the gas-residue separator 108. After entering the gas-residue separator 108, the non-gaseous by products (char) move downward into a collection vessel or other process equipment and the non-gaseous byproduct (vapor) move upwards. The gaseous byproduct may be further processed, such as for filtration of particulate matter, removal of vapors containing hetero atoms, catalytic cracking, hydro-cracking, condensing and refining, to obtain useful fuel oils. It shall be noted that any gaseous byproduct (off-gas) coming from the degradation process may be used to facilitate heating of the retort vessel 102. It shall also be noted that the apparatus design provides for continuous removal of residual matter from the retort vessel without the need to pause or halt the degradation process.

Additionally, while the process is described as a sequence of steps, this was done solely for the sake of facilitating understanding of the embodiments. Accordingly, it is contemplated that some steps may be added, some steps may be omitted, the order of the steps may be re-arranged, and/or some steps may be performed simultaneously.

Although embodiments have been described with reference to specific example embodiments, it will be evident that various modifications and changes may be made to these embodiments without departing from the broader spirit and scope of the system and method described herein. Accordingly, the specification and drawings are to be regarded in an illustrative rather than a restrictive sense.

Many alterations and modifications of the present invention will no doubt become apparent to a person of ordinary skill in the art after having read the foregoing description. It is to be understood that the phraseology or terminology employed herein is for the purpose of description and not of limitation. It is to be understood that the description above contains many specifications, these should not be construed as limiting the scope of the invention but as merely providing illustrations of some of the personally preferred embodiments of this invention. Thus the scope of the invention should be determined by the appended claims and their legal equivalents rather than by the examples given.

I claim:

1. An apparatus for thermal or thermal-catalytic degradation of feedstock, the apparatus comprising of:

a retort vessel, wherein the retort vessel:
- is configured to receive feedstock;
- includes at least one partition structure, wherein the partition structure:
  - is a flat plate;
  - divides the retort vessel into volumetric zones;
  - extends continuously along the retort vessel's length from an input end of the retort vessel to an output end of the retort vessel; and
  - has width equal to an inner diameter of the retort vessel;
- is declined to facilitate movement of the feedstock from the input end of the retort vessel towards the output end of the retort vessel;
- is tapered towards the output end;
- is configured to rotate angularly; and
- is heated to facilitate thermal degradation of the feedstock; and a gas-residue separator configured to separate gaseous and non-gaseous byproducts, wherein the gas-residue separator is provided at the output end of the retort vessel.

2. The apparatus according to claim 1, wherein the feedstock comprises at least one of, thermoplastics, biomass, organic matter, cellulosic fibre and other thermally decomposable material.

3. The apparatus according to claim 1, wherein the retort vessel is heated using at least one of, pressurized burners, electrical heaters or circulation of heat-transferring media.

4. The apparatus according to claim 1, wherein at least a part of fuel used in the heating is gaseous byproduct produced by thermal degradation of feedstock.

5. The apparatus according to claim 1, wherein declination of the retort vessel is varied by use of a worm wheel.

6. The apparatus according to claim 1, wherein declination of the retort vessel is varied-by using a hydraulic cylinder.

7. The apparatus according to claim 1, wherein the input end and output end of the retort vessel includes a nose heater.

8. The apparatus according to claim 1, wherein the retort vessel is constructed from material having high corrosive strength, wherein the material provides for corrosion resistance to any acidic vapors produced inside the retort vessel.

9. The apparatus according to claim 1, further comprising, a cooling jacket configured to reduce temperature at the input end.

10. The apparatus according to claim 1, further comprising of a leak-proof seal provided at the input and output end to stop gaseous byproducts from escaping into non-process equipment or atmosphere.

* * * * *